United States Patent [19]

Nakajima

[11] Patent Number: 4,669,381

[45] Date of Patent: Jun. 2, 1987

[54] CASSETTE TYPE LABELER AND CASSETTE CASE

[75] Inventor: Toshio Nakajima, Tokyo, Japan

[73] Assignee: Teraoka Seiko Co., Ltd., Tokyo, Japan

[21] Appl. No.: 787,759

[22] Filed: Oct. 15, 1985

Related U.S. Application Data

[60] Continuation of Ser. No. 571,422, Jan. 17, 1984, abandoned, which is a division of Ser. No. 398,901, Jul. 16, 1982, Pat. No. 4,578,140.

[30] Foreign Application Priority Data

| | | | |
|---|---|---|---|
| Jul. 21, 1981 | [JP] | Japan | 56-114078 |
| Jul. 29, 1981 | [JP] | Japan | 56-118996 |
| Aug. 5, 1981 | [JP] | Japan | 56-122684 |

[51] Int. Cl.[4] ..... B41J 3/20; B41J 15/04; B41K 3/68

[52] U.S. Cl. ..... 101/288; 400/120; 242/197; 156/384

[58] Field of Search ..... 101/288; 156/384, 584, 156/DIG. 48; 221/73; 242/197

[56] References Cited

U.S. PATENT DOCUMENTS

| | | | |
|---|---|---|---|
| 3,530,494 | 9/1970 | Bartatta | 221/73 |
| 3,767,098 | 10/1973 | Pabodie | 226/117 |
| 3,801,408 | 4/1974 | Kuring et al. | 156/584 |
| 3,813,056 | 5/1974 | Hagen et al. | 242/197 |
| 3,817,177 | 6/1974 | Arnam | 101/288 |
| 3,823,808 | 7/1974 | Murata | 400/613 |
| 3,834,650 | 9/1974 | Hall | 242/197 |
| 3,890,191 | 6/1975 | Mayer | 221/73 |
| 3,944,455 | 3/1976 | French | 156/584 |
| 3,951,061 | 4/1976 | Bremmer | 101/111 |
| 4,036,132 | 7/1977 | Ellefson | 101/288 |
| 4,073,234 | 2/1978 | Sato | 101/288 |
| 4,120,245 | 10/1978 | Karp et al. | 101/288 |
| 4,207,131 | 6/1980 | Hamisch, Jr. | 101/288 |
| 4,253,902 | 3/1981 | Yada | 156/584 |
| 4,297,039 | 10/1981 | Lees | 400/120 |
| 4,350,987 | 9/1982 | Hanagata et al. | 400/120 |
| 4,375,189 | 3/1983 | Berner | 101/288 |
| 4,385,958 | 5/1983 | Long | 156/384 |
| 4,407,692 | 10/1983 | Torbeck | 101/288 |
| 4,432,508 | 2/1984 | Inone et al. | 242/197 |
| 4,439,257 | 3/1984 | Sato et al. | 101/288 |
| 4,440,592 | 4/1984 | Sato et al. | 156/384 |

FOREIGN PATENT DOCUMENTS 54-16400 2/1979 Japan .

*Primary Examiner*—William Pieprz
*Attorney, Agent, or Firm*—Sandler & Greenblum

[57] ABSTRACT

A novel and easy-to-use labeler, also called a price gun, label gun, pricer or labeler, that can be used to fasten labels containing information on prices, commodity names, dates etc., to food articles and clothes, by workers at supermarkets, department stores, for example. The labeler includes a cassette case which stores labels, a label printer for printing labels, and a labeler body to which the cassette case is mounted, to intermittently feed the labels.

21 Claims, 40 Drawing Figures

CASSETTE TYPE LABELER AND CASSETTE CASE

This is a continuation of U.S. patent application Ser. No. 571,422, filed Jan. 17, 1984, now abandoned, which is a divisional of U.S. patent application Ser. No. 398,901, filed on July 16, 1982, now U.S. Pat. No. 4,578,140, issued on Mar. 25, 1986.

FIELD OF THE INVENTION

This invention relates to a handy labeler, more particularly to an improvement in a handy machine for labelling, which is called also as a price gun, label gun, pricer or labeler, and is used to fasten labels containing information on prices, commodity names, dates etc., to food articles and clothes, by workers at supermarkets, department stores and so on. Further, the invention relates to a cassette case which stores labels, and to a label printer for printing labels and for winding and housing a base sheet to which printed label is affixed, in the cassette case.

DESCRIPTION OF THE PRIOR ART

The conventional labeler comprises a labelled base sheet in the form of a roll which is wound around a paper tube or the like. The sheet fed from a roll housing to a printing section so that particulars such as prices may be printed in the printing section. Thereafter the roll is fed to a peeling section to peel off the label from the base sheet. The base sheet from which the label is peeled off, is then wound again in such a manner that the label is moved forward to a desired direction.

In other words, the labeler contains a label housing, a label guiding section, a label printing section and a label peeling section. Consequently, the labeler itself is very heavy. Furthermore, means are required for incorporating information to be printed into the labeler, and for printing. In addition, a delicate or elaborate mechanism is necessary for feeding or guiding the labelled base sheet in order through a housing, a guide, a printing section, a peeling off section and a driving section for feeding the base sheet. Consequently, a complicated adjustment operation must be effected so that correctly printed labels are fed and fastened to commodities.

Japanese examined patent publication No. 54-16400 discloses a labeler to which a roll of labelled base sheets is easily mounted. In this labeler, labelled tape is printed by a printer while the tape is fed through the labeler by operation of an means lever, between the outlet of a tape housing and a peeling base for peeling off the label. Accordingly, a portion of the labeler must be set aside for the printer in the path of the tape. This labeler offers no substantial simplification in the manner in which the tape is fed through the outlet of the labelled tape housing. In addition, there is no substantial simplification in the wheel for feeding out the tape, the printer, of the peeling base, although a means for setting the labelled tape to a labeler is simplified by the use of an improved labelled tape housing.

As explained above, conventional labelers have a printing section so that information or data is printed on the label immediately before the label is fed out from the labeler. The structure mentioned above, however, has drawbacks because a complicated operation is necessary for setting the input information, such as prices, into the printer. As a result, labeler is inefficient and is liable to errors. Further, since the rubber-made printing points are operated manually, letters are not always printed evenly or uniformly if uniform operative power is not applied, and defective labels are produced due to dust that may be introduced into a printing drum. In this way, conventional labelers suffer from the disadvantage that letters or figures do not appear uniformly due to uneven printing effected in the labeler.

SUMMARY OF THE INVENTION

One of the present objects of the invention is to provide an improved cassette type labeler in which a cassette case can be easily incorporated into the labeler body, wherein the cassette case stores a base sheet which carries a printed label, and wherein the case is provided with a peeling member for removing labels from the base sheet so that the sheet may be taken up by the labeler.

Another object of the invention is to provide a cassette type labeler which is light-weight and which is improved in ease-of-use. That is, it is an object of the present invention to provide a structure which needs no printing mechanism. As a result the labeler may be light-weight and the data-setting work of the complicated information for printing may be avoided. In other words, it is an object of the present invention to provide a structure for housing labels on which information or data has been printed prior to the time the label is fed through the labeler. Consequently, the letters and figures are evenly, correctly and readably printed well printed on the label to produce a label.

The third object of the present invention is to provide a cassette case which can be used with the cassette type labeler of the invention.

The fourth object of the present invention is to provide a handy and improved labeler comprising of a labeler body in which the labelled base sheet is smoothly fed and the peeled off label can be fastened to commodities without fail; and of a cassette case which can be mounted to the labeler body by an easy operation.

The fifth object of the present invention is to provide a label printer for winding and housing a printed label in the cassette case.

The cassette type labeler of the present invention comprises; a cassette case which stores a base sheet provided thereon with previously printed label (labelled base sheet), and which has a peeling member at its outlet opening so that the base sheet is curved so as to peel off the label; and of a labeler body on which the cassette case is mounted, and functions to feed the base sheet intermittently.

The cassette case of the invention is provided with an opening through which the labelled base sheet is extracted; a peeling member near the opening, which acts to bend the fed sheet to the rear so as to peel off the label from the base sheet; and a side member to feed the peeled base sheet in a desired direction.

The label printer of the invention, for printing labels fed one after another, comprises an input data unit for supplying a central processing unit with information data; a printing mechanism for printing the label and controlled by the central processing unit; and a labelled base sheet-feeding mechanism for feeding the base sheet. In addition, the cassette case is mounted to a mount frame provided near the feeding mechanism (feeder) so that the base sheet is provided with a printed label, is wounded and housed in the case in synchronism with the feeding movement of the feeder.

BRIEF DESCRIPTION OF THE DRAWINGS

FIG. 38 is a side sectional view, partially in section, of the cassette case to which labelled base sheet is wounded and stored in;

DESCRIPTION OF THE PREFERRED EMBODIMENTS OF THE INVENTION

Figure 1:
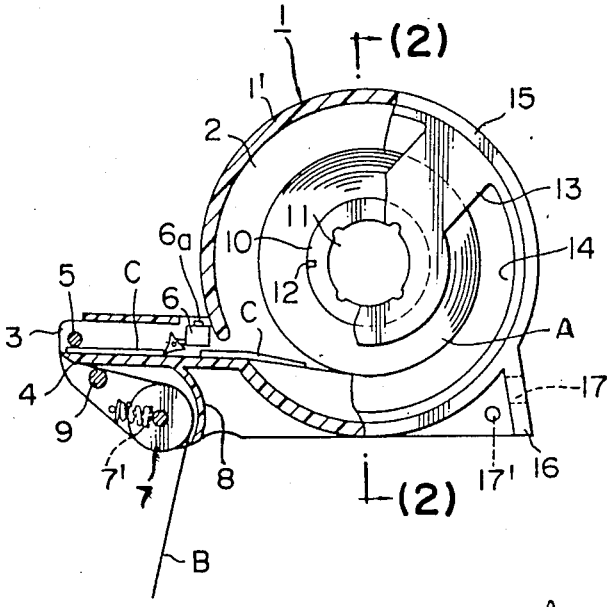
FIG. 1 is a side view, partially cut out, of a part of the cassette case of the invention.

FIG. 1 illustrates a cassette case 1 which is used for the labeler of the present invention. The cassette case 1 is so constituted that a labelled base sheet of a roll form is drawn out from a housing 2, through an opening 3. A peeling plate 4 is provided near the opening 3, for peeling a label C on which information data has already been printed, from its base sheet, while a set roller 5 is provided to face to the peeling plate 4. A reversible counter 6 is provided in the path between the housing 2 and the opening 3, so as to detect a gap or uneven portion between each of the labels C or the base sheet B and, thus, to count the number of labels passed. The counter 6 can make a reduction counting as well as an addition counting. It has a clear off button **6*a*** by which the number appeared in an indicator returns to zero.

A feeding roller 7 is provided behind the peeling plate 4, so as to feed the base sheet B curved by the plate 4 and the roller 5 in a predetermined tangential direction. A guide member 8 covers the feed roller 7 so as to guide the base paper B. Further, a position-setting pin 9 is provided near the peeling plate 4, so that the case 1' may be attach to a labeler body which will be explained later.

A rotatable supporting shaft 10 is provided at the center position of the housing. The shaft 10 supports or carries labelled base sheet A, and has a set hole 11. A slit 12 is provided at the circumference of the shaft 10 so as to stop the roll end of the labelled base sheet A. One side of the housing 2 may be provided with an openable cover 13 (of a transparent material so that the amount of the labelled base sheet A may be checked). Further, a mounting plate 16 having a setting hole 17, is attach to the circumference 15 of the housing 2.

The reference number 7' indicates a spring for pressing the feed roller 7 toward a guide member 8, and the number 17' is a position setting hole.

Figure 2:
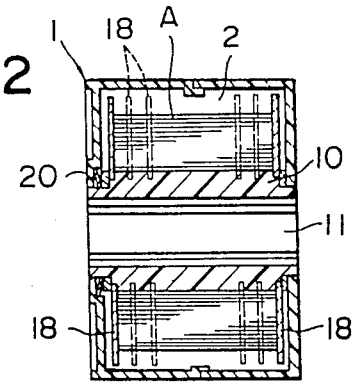
FIG. 2 is a sectional view along the line (2)—(2) of FIG. 1.
Figure 3:
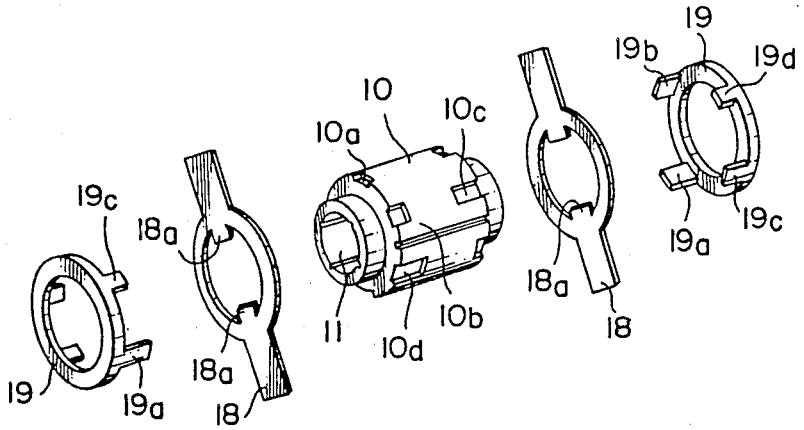
FIG. 3 is a perspective view showing parts constituting a supporting shaft for supporting or carrying the labelled base sheet.

FIGS. 2 and 3 illustrate a structure of a supporting shaft 10 which supports a labelled base sheet A. The shaft 10 of this embodiment has four kinds of position-setting grooves **10*a* through 10*d* of different lengths, at both ends. Fitting projections 18*a* of two roll setting plates 18, 18 are fitted in either pair of grooves 10*a* through 10*d*. After a labelled base sheet A is positioned between the two plates 18, set pieces 19*a* through 19*d* of a pair of set collars 19 are fitted in any of the position-set-grooves 10*a* through 10*d* so as to fix the roll set plates 18. The size of the base sheet B can be changed by selecting the combination of the set pieces 19*a* through 19*d* and of the position set grooves 10*a* through 10*d***.

In FIG. 2, reference number 20 is a plate spring positioned between a cassette case 1 and a set collar 19, and acts to hold the set plate 18 in position. Further, due to the friction generated by the spring 20 being applied to the supporting shaft 10, the labelled base sheet A does not become loose due to any shock or vibration.

The cassette case 1 is mounted to a manual type or electro-motive labeler body.

Figure 4:
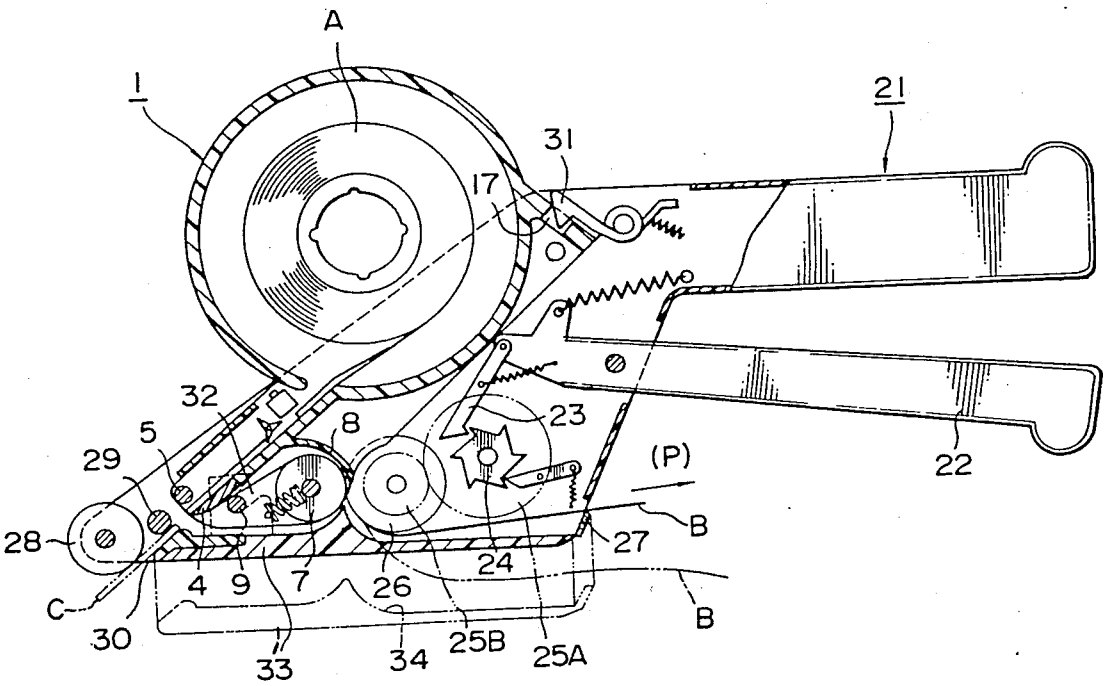
FIG. 4 is a side view, partially cut out, of the labeler to which the cassette case is mounted.

FIG. 4 illustrates an example of a manual labeler body 21 to which the cassette case 1 is removably mounted. With a manual operation (or electro-motive operation if desired) of the body 21, labels C are taken out one by one from the cassette case 1 and are stuck or fastened onto commodities. In operation, as seen in FIG. 4, a cassette case 1 is first mounted to the body 21 and an operation lever 22 is gripped. As a result of gripping, a ratchet claw 23 rotates a ratchet gear 24 one point. The rotation of the ratchet gear 24 is transmitted via an intermediate gear 25A to a driving roller 26. Consequently, the base sheet B held between the driving roller 26 and a feeding roller 7 which feeds the sheet B in a desired direction, moves forward by frictional power to the direction indicated by an arrow P.

A part of the driving roller 26 (or its cooperative member) may be formed into a sprocket so that a labelled base sheet A prior to the time it reaches a peeling plate 4, or a base sheet B may engage the sprocket with its feeding hole, so as to reliably carry out the intermittent feeding. A portion of the base sheet B which projects from a cutter 27, is cut by cutter 27.

Figure 5:
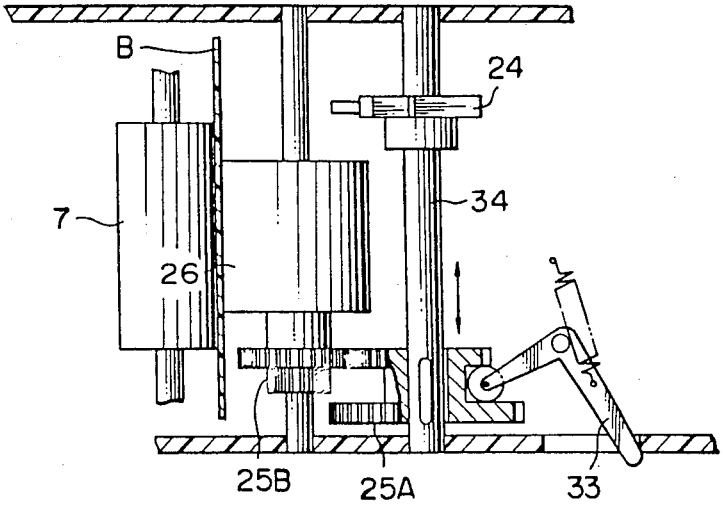
FIG. 5 is a view for illustrating the gear ratio of intermediate gears in the labeler.
Figure 6:
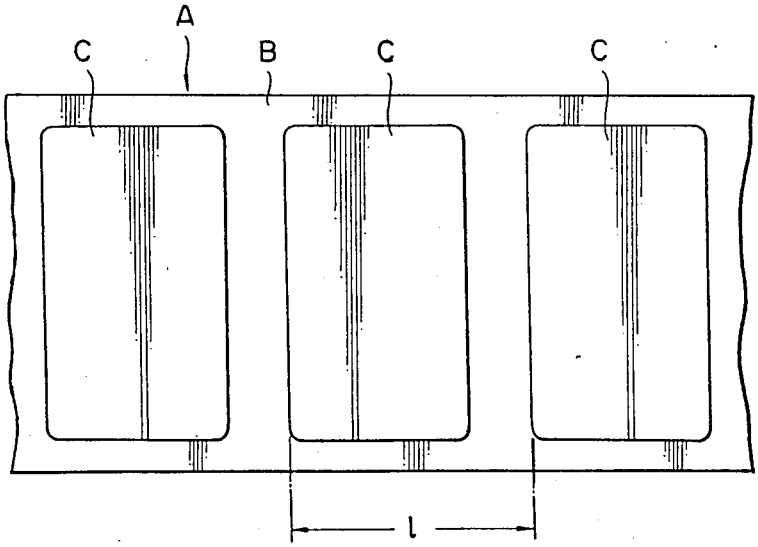
FIG. 6 is plan view for illustrating the size of label provided on a base sheet.

The gear ratio can be changed in two stages (or three stages.) That is, as will be seen in FIG. 5, by moving a change lever 33 along the gear shaft 34, either of intermediate gears 25A, 25B is operated. Consequently, in case a new label C is used (FIG. 6) whose size (l) is different from a former label C, a smooth gear change can be carried out.

Simultaneously with the feeding of the base sheet B, the label C is peeled off at the edge of the peeling plate 4, and is projected from under the fastening roller 28 as shown in dotted line 4 in FIG. 4. The label C is moved forward substantially straight under the roller 28 between a peeling plate 4 and a retainer roller 5, and between label accepting (receiving) shaft 29 of a labeler body 21 and a label accepting (receiving) plate 30. The label C projects from the labeler body 21, and can be fastened to commodities.

In this way, every gripping motion of the operating lever 22, feeds a new label C from cassette case 1 and is sticked to a commodity. The number of the used label C (or the remaining label) is indicated in a counter 6.

Changing the labelled base sheet A is effected as follows. A stop hook 31 is unfastened from a set hole 17 of the cassette case 1. Then a position-set-pin 9 is pulled out from a position-set-groove 32 (if the position-set-pin 9 is used as the position-set-groove, the groove 32 acts as a position-set-pin), so that the cassette case 1 is removed from the labeler 21.

A new cassette case 1 is mounted to a labeller body 21 as follows.

A base sheet B is moved so as to project from a feeding roller 7 and a guide member 8, and the top of the label C is positioned at a retainer roller 5. Then a bottom cover 33 of the labeler body 21 is opened as shown in a dotted line of FIG. 4. After the position-set-pin 9 is inserted into the position-set-groove 32, the stop hook 31 is hooked to the set hole 17 so as to fix the cassette case 1, to labeler body 21 and the bottom cover 33 is closed. The base sheet B which projects between the feeding roller 7 and the guide member 8, is thus positioned along the guide face 34 of the cover 33, as shown in full line of FIG. 4. After the cassette is fixed to the labeller 21, the label C is peeled off from its base sheet by gripping the operating lever 22, as mentioned above.

For placing a new labelled base sheet into the cassette case 1, either one of the following two methods may be used.

(i) A rolled base sheet A which is provided with a printed label (labelled base sheet) is set into a housing 2 in such a manner that its roll end is positioned at the outlet opening 3, and that the base sheet B is projected from between the feeding roller 7 and the guide member 8. Then the housing 2 and the opening 3 are closed by a cover 13.

(ii) The starting end of the roll of the labelled base sheet A is inserted into a slit 12 of a supporting shaft 10. A driving shaft is pushed into a set hole 11 so that the labelled base sheet A may be wounded therearound. Then a base sheet C is made to project between the feeding roller 7 and the guide member 8. Since the number of the label C is indicated in the counter 6, it is possible to store a required number of labels C in the housing 2. An auto-loading mechanism may be provided to the supporting shaft 10.

FIGS. 7 through 25 show combinations of various cassette cases and labeler bodies of the invention. In these drawings, a reference number 100 indicates a cassette case, 150 is a labeler body, A' is a labelled base sheet, B' is a base sheet, C' is a label.

The cassette case 100 has a housing 102 inside its case body 101, so that a labelled base sheet A' is wounded around a rotable supporting shaft 110 provided in the housing 102. An end of the labelled base sheet A' is positioned to be drawn out from an outlet opening 103 provided at the front position of the case body 101. Near the opening 103 are provided a peeling shaft 104 and a set roller 105. The labelled base sheet A' is curved by means of the peeling shaft 104, toward the rearside of the shaft 104 and, accordingly, the label C' is peeled off from the base sheet B'. The peeling shaft 104 may be rotatable or stable.

The structure mentioned above, is substantially identical to that for the previously mentioned cassette case 1. In the drawings, a reference number 106 indicates a guide roller, 111 is a stop hole provided in a supporting shaft 110, 112 is a slit for stopping the roll start of the labelled base sheet A'.

The case body 101 consists of a front case 101*a* in which a front opening 103, a peeling shaft 104, a set roller 105, a guide roller 106 and a supporting shaft 110 are provided, and a rear case 101*b* which covers the rearside of said front case 101*a*. The two case members 101*a* and 101*b* are fixed to each other by a hinge 107, and form the housing 102.

Figure 7:
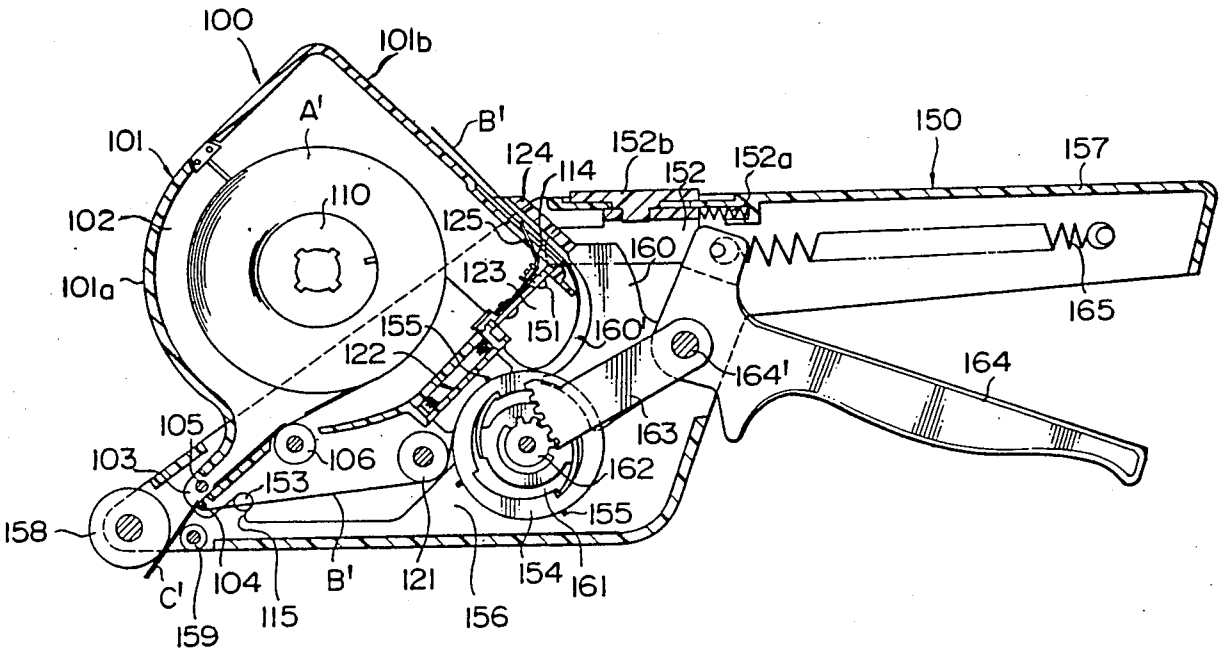
FIG. 7 is a side sectional view of another embodiment of the labeler according to the invention.
Figure 8:
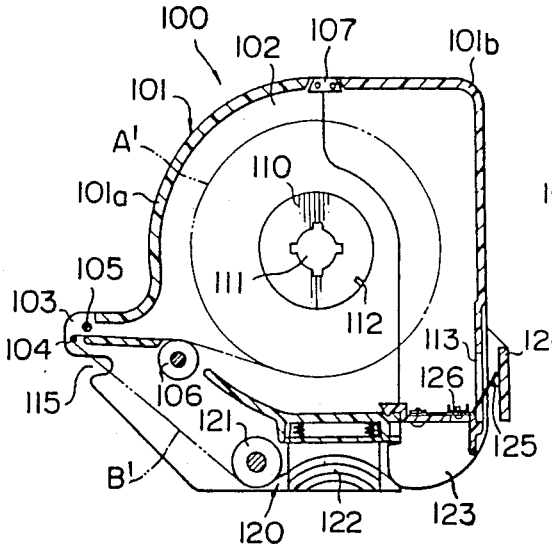
FIG. 8 is a side sectional view of the cassette case taken along the line (8)—(8) of FIG. 9.
Figure 9:
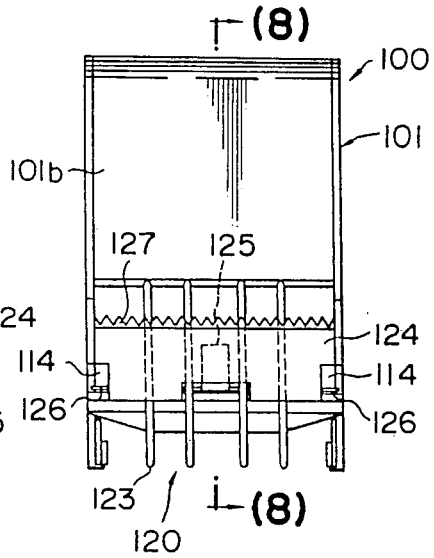
FIG. 9 is a back view of the cassette case.

The cassette case 100 has, as will be seen from FIGS. 7 through 9, a guide roller 121, a sheet allowing (accepting) member 122 and a guide plate 123 at the rearside of the peeling shaft 104, i.e. at the rear bottom of the case body 101, and a guide frame 124 at its lower back portion. With such a structure, a base sheet B' is bended by the peeling shaft 104 toward the rear side of the shaft 104, and guided to a predetermined direction along said members 121, 122, 123 and 124.

The above mentioned members 121, 122, 123, 124 form, in combination, a guide 120 for the base sheet B', while a guide frame 124 together with a sheet-set-plate 125 mentioned later, constitute a sheet stop mechanism.

The guide roller 121 and the sheet accepting member 122 are provided at the bottom of the front case 101*a*, while the guide plate 123 and the guide frame 124 are formed in the rear case 101*b*. The guide plate 123 is inclined so that the base sheet B' may be smoothly guided from the sheet accepting member 122 to the guide frame 124. The guide plate 123 consists of plurality of plates in order to decrease the friction to the base sheet B'.

the guide frame 124 need not necessarily be provided at the back portion of the case body 101. If desired, the guide frame 124 may be formed at the position of the guide plate 124. The guide frame 124 is projected from the lower back portion of the rear case 101*b*, so that the base sheet B' goes through the space between the plate 124 and the rear case 101*b*.

The rear case 101*b* has a hole 113 at its center portion facing the guide frame 124. An end of the sheet-set-plate 125 is fixed to the frame 124 while the other end is fixed to the inside surface of the case 101*b* through the hole 113.

Figure 10:
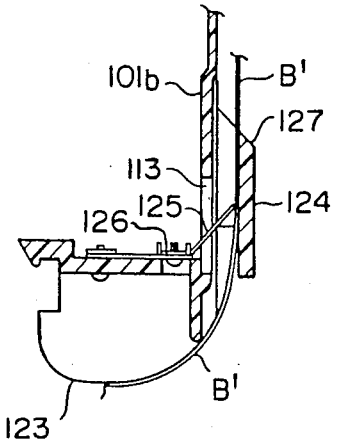
FIG. 10 is an enlarged view of a guide frame which constitutes a temporary stopper of a base sheet, provided for the cassette case.
Figure 11:
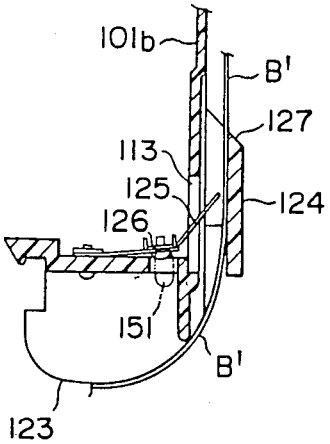
FIG. 11 is an enlarged view of a guide frame for the cassette case shown in FIG. 7.
Figure 12:
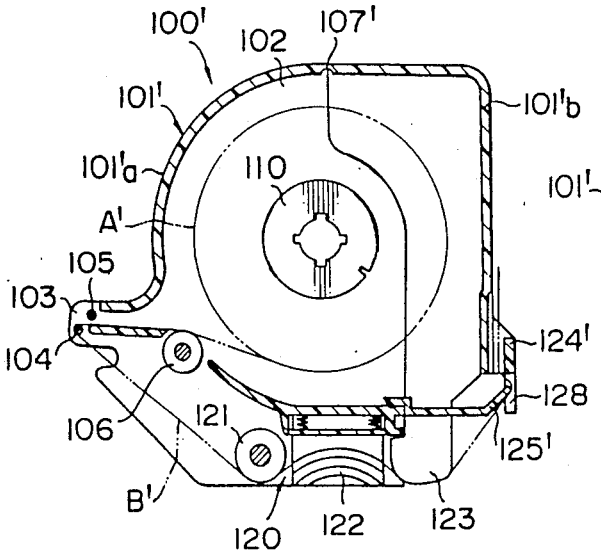
FIG. 12 is a side sectional view along the line (12)—(12) of FIG. 13, of an another embodiment of the cassette case of the invention.
Figure 13:
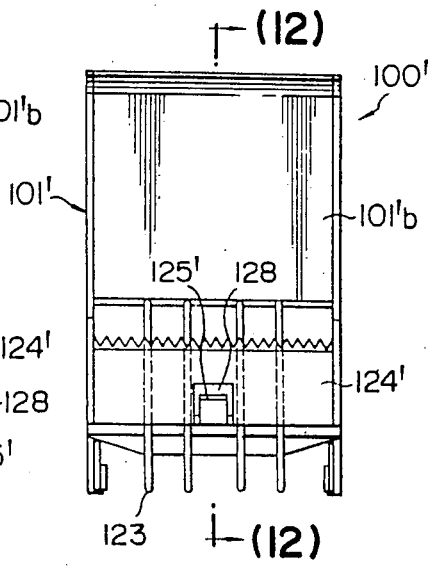
FIG. 13 is a back view of the cassette case shown in FIG. 12.
Figure 14:
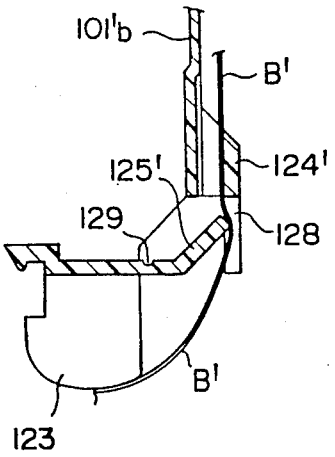
FIG. 14 is an enlarged view of the guide frame of the cassette case shown in FIG. 12.
Figure 15:
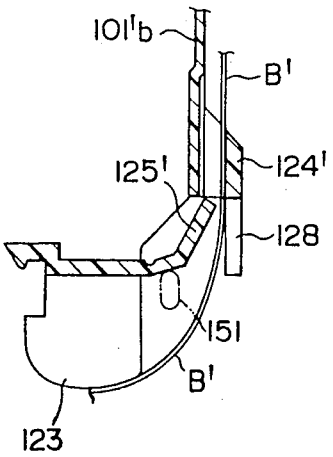
FIG. 15 is an enlarged view of the guide frame similar to FIG. 14, but at the stage where the cassette case is mounted to the labeler body.

The set-plate 125 is formed of a plate spring which can spring up. Due to the springing movement, the plate end can touch or be spaced from the guide frame 124 (FIGS. 10 and 11). That is, the plate 125 holds the base sheet B' springingly onto the guide frame 124 (FIG. 10) while the base sheet B' is released when the plate 125 springs off from the guide frame 124 (FIG. 11). Thus, the guide frame 124 and the sheet-set-plate 125, in combination, act as a sheet stop mechanism.

The set-plate 125 has a push arm 126 which projects to both sides. The back case 101*b* is provided with cut holes 114, 114 which face to the ends of the arm 126, so that the ends of the arm 126 project through the holes 114, 114.

When the case 100 is mounted to a labeler body 150, a knock pin 151 of the body 150 goes through the holes 114, 114 so as to collide with the arm end 126, and thus to raise the set plate 125. In consequence, the plate 125 detaches from the guide frame 124. Accordingly, the base sheet B' is released.

The holes 114, 114 act in cooperation with a lock arm 152 provided movably to the body 150, as a mechanism for locking the cassette case 100 to the body 150.

The front case 101*a* has a cut out recess 115 at its front end, so that a pin 153 of the labeler body 150 may fit into the recess to attach the case to the labler body 150.

The guide frame 124 is provided at its upper end with a cutter 127 so that the base sheet B' feeded from the frame 124 is cut down. The cutter 127 may be formed integral with the frame 124 or separately.

FIGS. 12 to 15 illustrate a cassette 100' which is a variation of the cassette 100 described above. The cassette 100' comprises a case body 101' which is composed of a front case 101'*a* and rear case 101'*b* which are integrally molded from polypropylene resin or other material, and also comprises a guide frome 124' and base-sheet set plate 125' which are integrally molded.

The junction of the front case 101'*a* and rear case 101'*b* is provided with a thin portion or a bent or curved portion, where a hinge 107' is provided for enabling the two cases 101'*a* and 101'*b* to be opened and closed.

The guide frame 124' is provided with a window 128, and the bottom wall of the rear case 101'*b* is partially projected into the window 128 to form a set plate 125'.

The above-mentioned set plate 125' functions as a leaf spring which elastically rises and falls, a around recess 129 near the non-loose end of the plate. When the set plate 125' projects into the window 128, the set plate 125' and window 128 cooperate so as to hold the base sheet (B') between them and may release the base sheet (B') from being thus held as the set plate 125' separates from the window 128.

The above-mentioned base sheet (B') is provided with holes (b, b, . . . ) at constant intervals so that the holes (b, b, . . . ) may engage with the feed claws 155 of the sprocket 154 in the main body 150.

Figure 19:
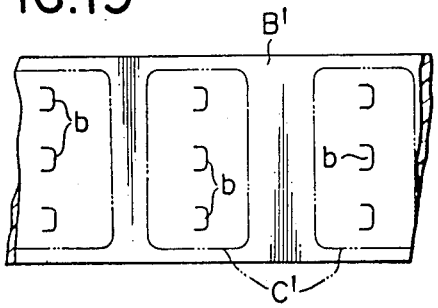
FIG. 19 is a bottom view of the base sheet.

The holes (b, b, . . . ) need not be shaped round but may be shaped in the form of a u-slit as in FIG. 19, and also need not be in one row but may be two or more rows. Base sheet (B') may be provided with the slits (b, b, . . . ) as in FIG. 19 under labels (C', C', . . . ), so that when a label (C') peels off, the U-slit portions appear and form holes in the base sheet.

The main body 150 of the labeler has in the front a cassette containing portion 156 whose front is open, and also has a grip 157 projecting rearward. At the front bottom of the main body 150, a labeling roller 158 and label-receiving rolle 159 are rotatably provided front and back with an appropriate space between them. In the above-mentioned cassette containing portion 156 of the labeler main body 150, the aforementioned locking rod 152 is provided at the top so as to be able to project horizontally, and a dowel pin 151 is projected near the bottom of the locking rod 152. At the front bottom of the cassette containing portion 156, a supporting pin 153 is projected laterally.

The above-mentioned locking rod 152 is provided with a spring 152*a* to bias rod 152 forward, and a lock release 152*b* is projected above the grip 157.

The above locking rod 152 and supporting pin 153 compose a lock mechanism to support and fix in the cassette containing portion 156 a cassette 100 which is set on the labeler main-body 150.

As the cassette 100 is pushed, with the guide member 120 faced downward, into the cassette containing portion 156 of the labeler main-body 150, the back of the case body 101 moves back the locking rod 152 against the elastic force of the spring 152*a*. When the rod 152 reaches a position in which the rod 152 opposes the cutout hole 114 of the case body 101, the elastic force of the spring 152*a* causes the rod 152 to move forward into the cutout hole 114, and the supporting pin 153 engages with the cutout 115 of the case body, for thereby preventing the cassette 100 from coming out and for holding the cassette 100 in a loaded state.

By pulling the above-mentioned lock release rearward to move back the locking rod 152 thereby letting the rod 152 come out of the cutout hole 115, the cassette 100 can be extracted from the cassette containing portion 156.

The cassette 100 can therefore be freely set in and separated (detached) from the labeler main body 150.

The aforementioned dowel pin 151 pushes up, when the cassette 100 is set in the cassette containing portion 156 as above, the arm 126 of the base-sheet set plate through the bottom of the cutout hole 114 of the case body 101, and this causes the set plate 125 to separate from the guide frame 124 and releases the base sheet (B') from being held, enabling the base sheet (B') to be sent out.

The cassette containing portion 156 is provided with the aforementioned sprocket 154, which is rotatably borne at the position opposite to the sheet receiving member 122 of the cassette 100 set in the cassette containing portion 156, and is also provided with a main-body-side guide 160 at the position opposite to the guide plate 123.

The sprocket 154 is arranged so as to let the base sheet (B') be inserted between the sprocket 154 and the above-mentioned sheet receiving member 122 and to have the feed claws 155 of the rotating sprocket 154 engage with the holes (b) made in the base sheet (B'). The rotation of the feed claws engaging with the holes (b) moves base sheet (B').

The main-body-side guide 160 has a curved face corresponding to the curved shape of the aforementioned guide plate 123 to form a guide path 160' between them 123 and 160 for leading the base sheet (B') to the guide frame 124. By the intervention of this main-body-side guide 160, the base sheet (B') having passed the sheet receiving member 122 is securely sent toward the guide frame 124, and even in case, for example, that the cassette 100 is set in the labeler main-body 15 in the condition that the tip of the base sheet (B') is positioned immediately after the sheet receiving member 122, or that the base sheet (B') is cut before the guide frame 124, the tip of the base sheet (B') can be led into the guide frame 124 through the above-mentioned guide path 160'.

The aforementioned sprocket 154 is connected with a gear 162 via a one-way clutch 161 so that the sprocket 154 may be rotated only in the direction in which the base sheet (B') is carried rearward. One end of a driving arm 163 comprises teeth adapted to engage the gear 162. The other end of arm 163 is rotatably mounted on a lever shaft 164'.

One end of a lever 164 is fixed to the above-mentioned driving arm 163, and the top of the arm 163 is provided with a spring 165 to project the lever 164 below the grip 157.

Therefore, as the labeler user holds the grip 157 of the labeler main-body 150 by hand and moves up the lever 164 by clenching it, the sprocket 154 turns clockwise as viewed as in FIG. 7. This causes a fixed length of the base sheet (B') to be moved by the rotation of feed claws 155 which engage openings in sheet B'. As a result the base sheet with labels (A') in the cassette 100 is drawn out, a label (C') is peeled off the base sheet (B') and moved through the opening 103 of the case body 101 and is held between the rollers 158 and 159 so as to be ready for attachment to a target object.

As the clenched lever 164 is released to move downwardly, the driving arm 163 and gear 162 move back, but the sprocket 154 does not rotate because of the intervention of the one-way clutch 161.

The above-mentioned one-way clutch 161 may alternatively be arranged to be driven in the opposite direction so that the sprocket may turn to issue a label (C') when the lever 164 moves down.

The above-described cassette 100 can be set for immediate issue a label simply by inserting the case body 101 into the cassette containing portion of the labeler mainbody 150. Case body 101 is removable by operating the lock release **152*b* of the locking rod 152. Since the cassette 100 holds the base sheet (B') between the guide frame 124 and set plate 125, the base sheet (B') does not hang but is kept along the guide member 120; therefore, the cassette 100 is not only easy to set in the labeler main-body 150 but also convenient to carry. The above is similarly applicable to the cassette 100' illustrated in FIGS. 12 to 15** as well.

Next the aforementioned sheet receiving member 122 will be discussed in detail. Sheet receiving member 122 is provided for the smooth engagement of the feed holes (b) of the base sheet (B') with feed claws 155 of the sprocket 154 in using the labeler after setting the cassette 100 or 100' in the labeler main-body 150.

Figure 16:
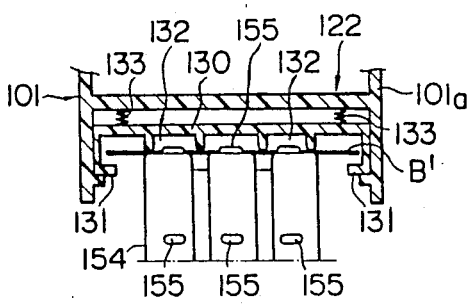
FIG. 16 is a sectional view of the base sheet feeder for the labeler along the line (16)—(16) of FIG. 7.
Figure 17:
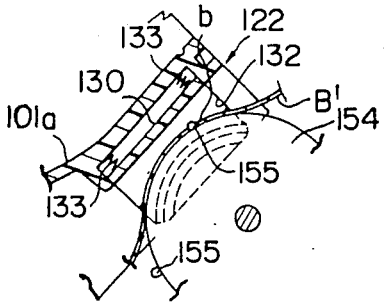
FIG. 17 is a side sectional view of the base sheet feeder shown in FIG. 16.
Figure 20:
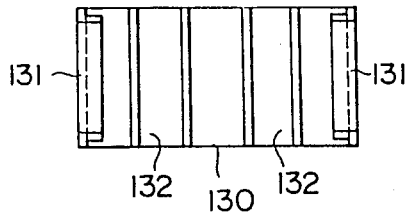
FIG. 20 is a bottom view of a sheet accepting member.
Figure 18:
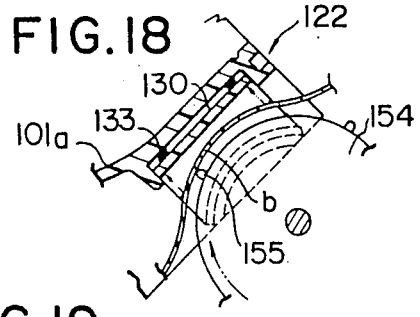
FIG. 18 is a side view illustrating the base sheet feeding movement.

As shown in FIGS. 16 to 18, the sheet receiving member 122 is composed of a sheet receiving plate 130 and right and left side plates 131 and 131. The receiving plate 130 is shaped to be in the form of a curved face along the circumferential face of the aforementioned sprocket 154, and the curved face is provided with grooves 132 to engage the feed claws 155. The side plates 131, 131 are in the form of an L which project from the right and left side edges of the receiving plate 130.

The sheet receiving plate 130 is fixed to the case body 101, more particularly to the bottom face of the front case **101*a*, and is detachable and adapted slide up and down. Coiled springs 133 are provided between the receiving plate 130 and front case 101*a* in order to bias the receiving plate 130 toward the sprocket 154**.

The right and left side plates 131, 131 are arranged with such a space between them as to contact the right and left side edges of the base sheet (B') which is disposed along the bottom of the receiving plate 130. Plates 131, 131 function to position the base sheet (B') which runs under the receiving plate 130 in the lateral direction, so that the feed holes (b) of the base sheet (B') may be positioned on the tracks through which the feed claws 155 of the sprocket 154 rotate.

By the intervention of the above-mentioned coiled springs 133, the receiving plate 130 is elastically biases in the direction of the sprocket 164, and contacts sprocket 154. Springs 133 function to bias the base sheet (B') running under the receiving plate 130 into contact with the feed claws 155 of the sprocket 154.

Even if the holes (b) of the base sheet (B') do not engage feed claws 155 of the sprocket when the cassette 100 is set in the labeler main-body 150, springs 133 function to move the base sheet (B') upward elastically together with the receiving plate 130, when the feed claws 155 of the sprocket 154 slide on the bottom face of the base sheet (B'). As a result the feed claws 155 move, by sliding on the base sheet (B') in light contact therewith or idling under sheet (B'), to the position of the next holes (b), where the feed claws 155 once again engage the holes (b) to again start feeding the base sheet (B').

The above operation makes the attaching of cassette 100 easy and certain, and prevents the feed claws 155 from unreasonably catching on the base sheet (B') when that the feed claws 155 do not engage the holes (b), thereby keeping the base sheet (B') from possibly being broken or otherwise damaged.

Although the aforementioned side plates 131, 131 are illustrated (in FIG. 16) to be formed as molded integrally with the sheet receiving plate 130, the side plates 131, 131 may be separated from the receiving plate 130 and detachably fixed to the receiving plate 130 or case body 101.

Figure 21:
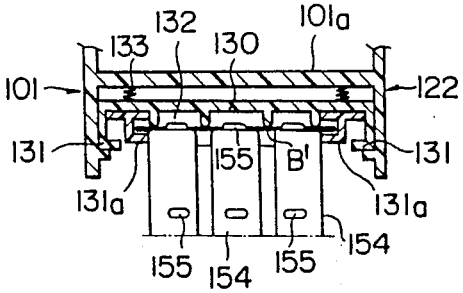
FIG. 21 is a sectional view of another embodiment of the sheet accepting member.

In the embodiment which the side plates are detachably fixed to the receiving plate the case body, the space between the two side plates may be increased or decrased so as to accommodate a base sheets (B') of different widths. FIG. 21 shows side plates 131 integrally projecting from the sheet receiving plate 130 and auxiliary side plates **131*a* which are formed of different members and are detachably fixed to the inside of the side plates 131** in order to decrease the space between the side plates.

The above-mentioned auxiliary side plates 131*a* may be provided on the inner side of the side plates 131 of the receiving plates 130 shown in FIG. 16 and may also be detachably fixed to either receiving plate 130 or case body 101.

Figure 22:
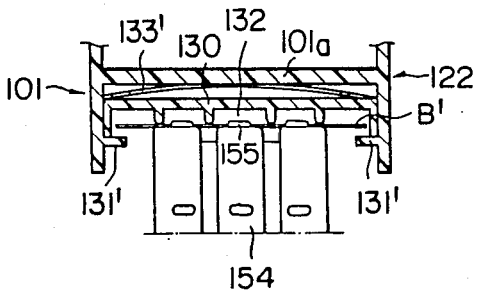
FIG. 22 is a sectional view of a still another embodiment of the sheet accepting member.
Figure 23:
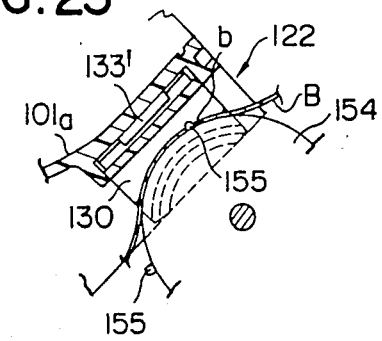
FIG. 23 is a side view of the sheet accepting member.
Figure 24:
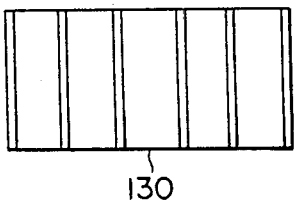
FIG. 24 is a bottom view of the sheet accepting member shown in FIG. 22.

FIGS. 22 to 24 show an embodiment in which side plates 131' which are formed integrally with the case body 101. In this embodiment a leaf (plate) spring 133' is used instead of the aforementioned coiled springs 133. The above spring mechanism is not restricted to the coiled springs 133 and leaf spring 133', but may also be provided by, for example, using rubber or other cushion material or using an elastic body integral projecting from the receiving plate 130 or case body 101.

Figure 25:
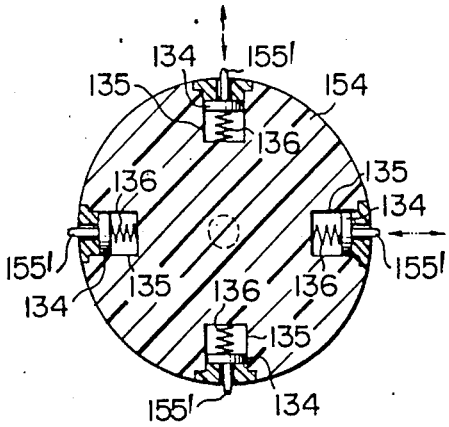
FIG. 25 is a side sectional view of a variant of a sprocket which is an embodiment of the base sheet feeder.

FIG. 25 illustrates another embodiment in which the above-mentioned spring function is provided on the feed-claw, that is, the sheet receiving member 122 is not provided with the springs 133 or spring 133' but rather the receiving plate 130 is fixed and the feed claws 155' of the sprocket 154 are provided with a spring. As seen in FIG. 25, a piston head 134 is provided under the feed claw 155', and is fitted in a cylinder slot 135. Piston head 134 is adapted project from slot 135 via the action of a coiled spring 136 inside the cylinder groove, so that the feed claw 155' may retreat into the cylinder groove 135 when the feed claw 155' does not engage the hole (b) of the base sheet (B').

Figure 27:
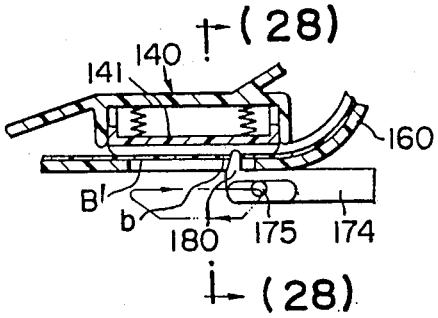
FIG. 27 is a side sectional view of the base sheet feeder.
Figure 28:
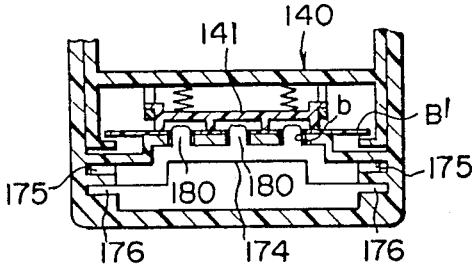
FIG. 28 is a sectional view of the feeder along the line (28)—(28) of FIG. 27.
Figure 26:
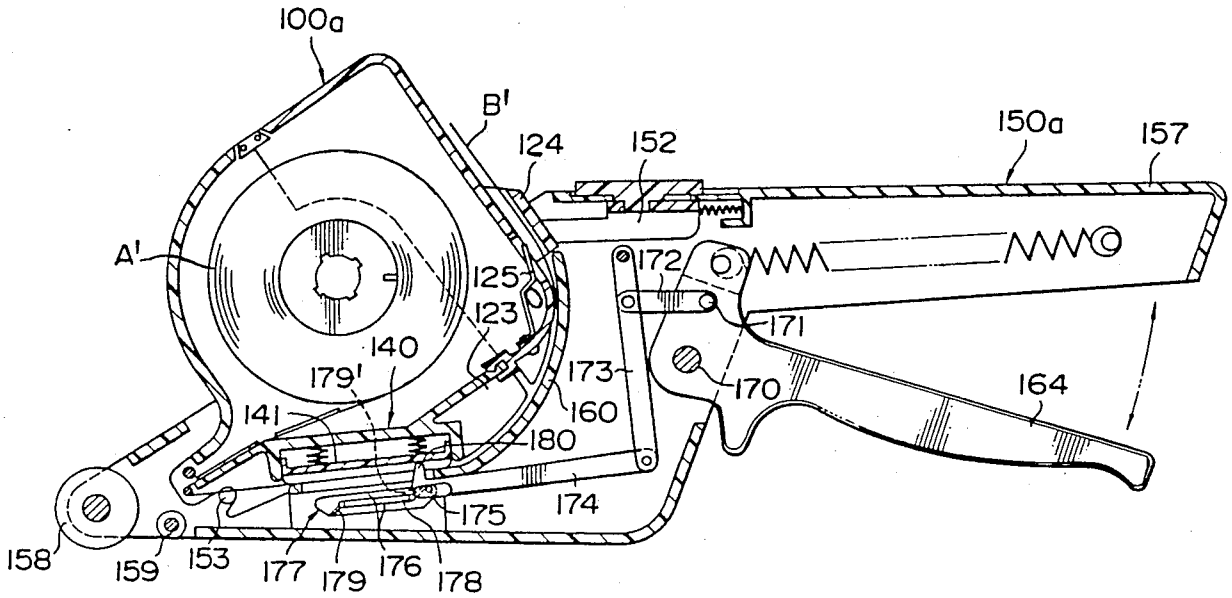
FIG. 26 is a side sectional view of a labeler provided with a variant of the base sheet feeder.

FIGS. 26 to 28 show a modification of the base sheet feeding mechanism, in which a link mechanism is used instead of the aforementioned sprocket. For the convenience of easy understanding, the members which are identical or similar to the aforementioned members are numbered the same, and explanation of these members are omitted.

The sheet receiving member 140 of the cassette 100*a* is provided with a sheet receiving plate 141 which is in the form of a flat plate. Referring to FIG. 26, the labeler main-body 150*a* is provided with a lever fulcrum shaft 170 and link fulcrum shaft 171, which are both fixed shafts. As the lever 164 is moved upward, a connecting link rod 172 moves a driving link rod 173 forward, and a feeding link rod 174 then moves forward. As the lever 164 moves downward, the feeding link rod 174 is moved rearward through the above rods 172 and 173.

At the tip of the above-mentioned feeding link rod 174 is a guide pin 175, which is fitted in a guide groove 176. The guide groove 176 is a long hole 177, which is sectioned up and down with a partition 178, and one end of the partition 178 is provided with a one-way stopper 179 and the other end is provided with a similar one-way stopper 179', so that the guide pin may rotate in the clockwise direction, in FIG. 26, only. Feed claws 180 are provided at the tip of the feeding link rod 174.

As the lever 164 is moved up and down, the feed claws 180 carry the base sheet (B') rearward; therefore, the label (C') projects between a sticking roller 158 and label receiving roller 159. If the feed claws 180 do not engage with the holes (b), the sheet receiving member 140 moves up, and the feed claws 180 lightly slide on the base sheet (B') face until the feed claws 180 engage the holes (b).

Figure 30:
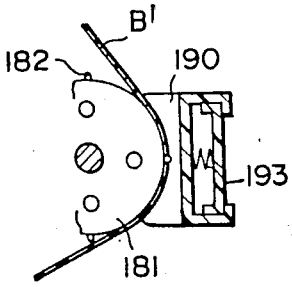
FIG. 30 is a side view of the feeder of FIG. 29.
Figure 31:
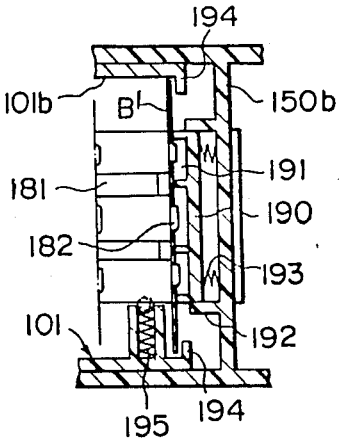
FIG. 31 is a plan view of the feeder of FIG. 30.
Figure 29:
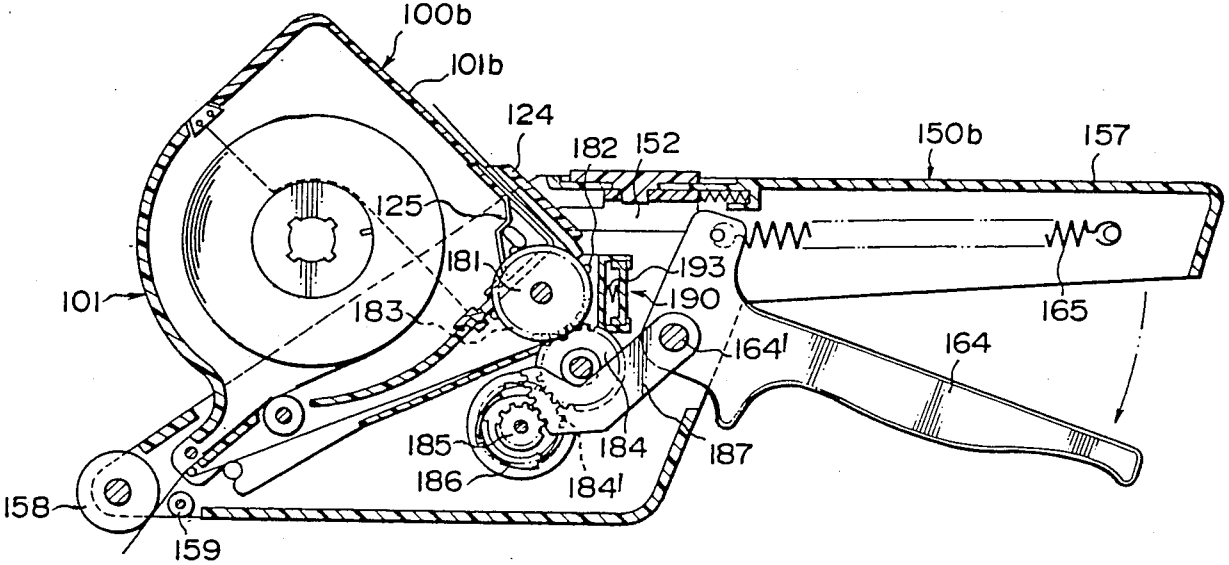
FIG. 29 is a side sectional view of a labeler provided with still another variant of the base sheet feeder.

FIGS. 29 to 31 illustrate the construction in which the aforementioned sprocket is provided in the cassette 100*b*. The cassette 100*b* has a sprocket 181, which is rotatably mounted at the rear bottom, more particularly at the position of the aforementioned guide plate 123 from which the guide plate has been eliminated, of the case body 101. The base sheet (B') is led around the sprocket 181, and then travels to the guide frame 124.

The sprocket 181 is provided with feed claws on the circumference. The sheet receiving member 122 is omitted from the cassette 100*b*.

The labeler main-body 150*b* is provided with a sheet receiving member 190 at a position opposite to the above-mentioned sprocket 181. The sheet receiving member 190 has a cylindrical surface, and is provided with escape grooves 191. Member 190 contacts the labeler main-body 150*b* via coiled springs 193 and is guided with guide plates 192.

The above-mentioned sprocket 181 is provided with a driven gear 183 to be rotated by a driving gear 185 through intermediate gears 184 and 184'. The driving gear 185, is rotated in response to rotation of a driving arm 187 via a one-way clutch 186.

By moving the lever 164 up and down, the label (C') can be projected between the sticking roller 158 and label receiving roller 159.

Referring to FIG. 31, side plates 194 are formed on the cassette 100*b* side in order to position the base sheet (B'), and an elastic member 195 contacts the side face of the sprocket 181.

Figure 32:
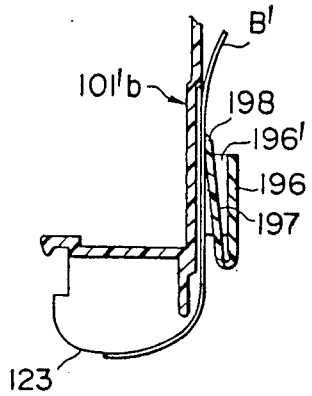
FIG. 32 is a side sectional view of the important part of a variant of a temporary stopping mechanism provided for the cassette case.
Figure 33:
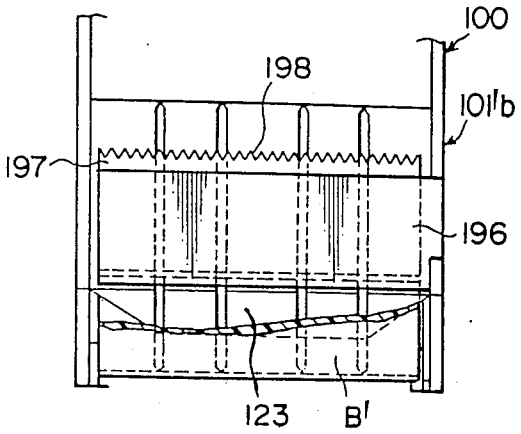
FIG. 33 is a back view of FIG. 32.
Figure 34:
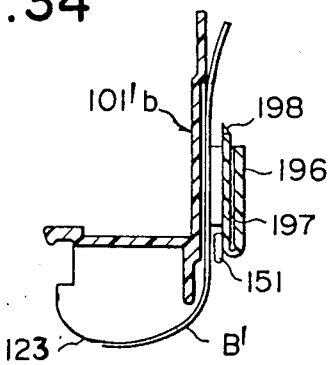
FIG. 34 is a side sectional view of stopping mechanism showing that the base sheet is released from its stopped condition.
Figure 35:
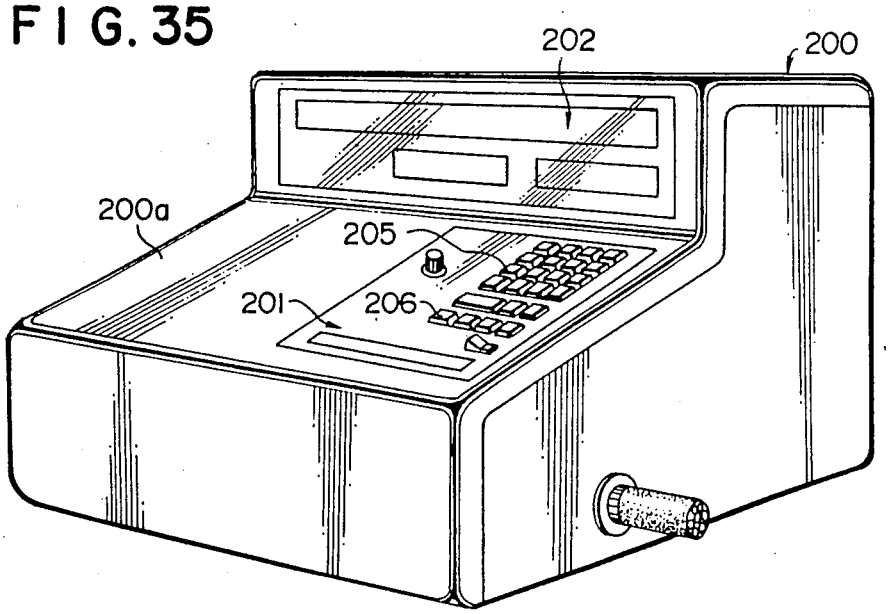
FIG. 35 is a perspective view of the label printer of the invention.
Figure 36:
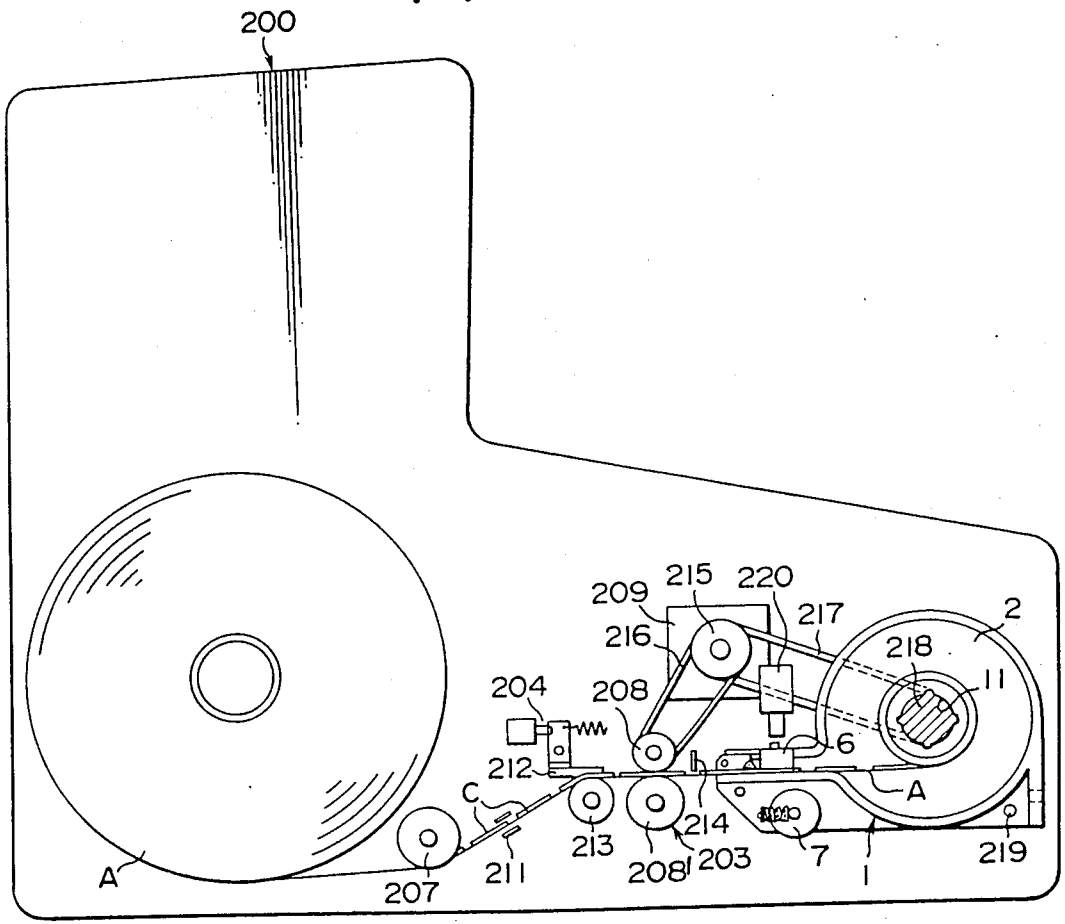
FIG. 36 is a side sectional view of the printer shown in FIG. 35.
Figure 37:
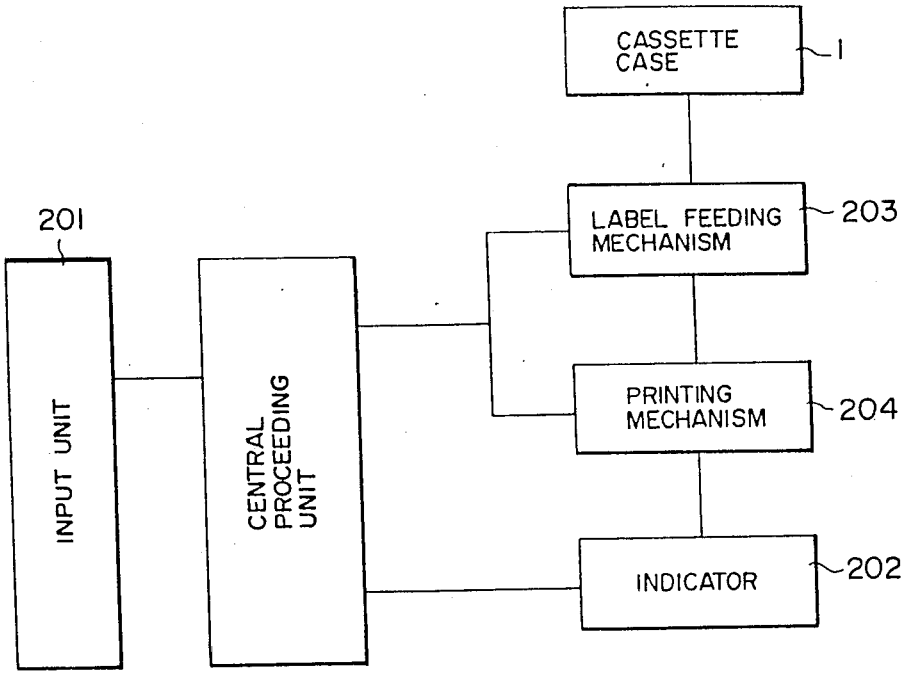
FIG. 37 is a block diagram explaining the structure of the printer.
Figure 38:
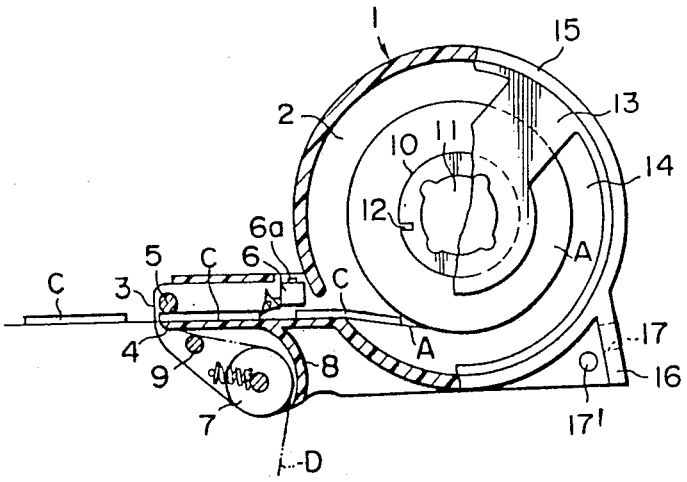

FIGS. 32 to 34 illustrate a modification of the base sheet temporary fixer mechanism. In FIGS. 32 to 34, a fixing piece 196 is provided, either integrally with or as a separate body from the rear case 101'*b* of the cassette 100, via a lug 196' at the rear bottom of the rear case 101'*b*, that is, at the position corresponding to the portion where the aforementioned guide frame 124 is provided.

The fixing piece 196 is shaped so as to be opposed to the approximately entire width of the rear case 101'*b* and a base sheet set plate 197 which extends toward the rear case 101'*b* side is provided at the bottom end of the fixing piece 196.

The above-mentioned set plate 197 may either be molded integrally with the fixing piece 196 or may be provided by fixing a separate member, and is fixed so as to be able to rise and fall so that the top end may contact and separate from the rear case 101'*b*.

The set plate 197 is constructed to be a spring to bias the top end toward the rear case 101'*b*, and the top end is projects from the top end of the fixing piece 196 and is provided with a cutter 198 at the top-end edge.

The above-mentioned set plate 197 holds the base sheet (B') between the set plate 197 and rear case 101'*b* thereby temporarily fixing and holding the base sheet (B').

When the cassette 100 is set in the labeler mainbody 150, the above-mentioned set plate 197 is raised by the dowel pin 151 of the main body 150 to be detached from the rear case 101'*b* thereby releasing the base sheet (B') from its temporarily fixed state (as in FIG. 34).

Thus, the above-mentioned rear case 101'*b* and set plate 197 comprise a temporarily fixing mechanism.

Although the fixing piece 196 is illustrated as constructed to be connected to the rear case 101'*b* by means of a lug 196' on one side, the fixing piece 196 may be constructed to be connected to the rear case on both right and left sides, and the fixing piece 196 may be cut apart in the middle.

It is also within the scope of the invention that one or more of the set plate 197 are formed on part or parts, for example, the center, right side and/or left side, of the fixing piece, and that the top end of the set plate 197 is formed to be below the top end of the fixing piece and the aforementioned cutter 198 is provided at the top edge of the fixing piece.

FIGS. 35 to 38 illustrate a label printer 200 for printing labels that are taken up and stored by the above-described cassette 1.

Referring to FIGS. 35 to 38, label printer 200 has: an input unit 201; an indicator (display) 202 flush on the front side of the cabinet 200*a;* a central processing unit (CPU); a label feeding mechanism 203; and a printing mechanism 204 installed inside the cabinet. The cassette (1) to be described later is set on one side of the above-mentioned input unit 201 in cabinet 200*a*.

The input unit 201 comprises ten-keys 205, function keys 206 and various other keys and switches. By means of the ten-keys 205 and function keys 206, a variety of necessary merchandise data, such as the name of merchandise, the date of processing, the expiration date of the merchandise's effectiveness, tare, the unit price, the weight, the price, the code number, the bar code or bar-code code system, and the number of issued labels, are fed into the printer where they are converted into signals and sent to the central processing unit (CPU).

It is within the scope of the invention to use input means other than input section 201. For example, a cassette tape system having a tape with which predetermined data stored thereon may be used. Alternatively, inputing data can be performed by writing, with a light pen, or by using a magnetic tape or floppy disk, or other system.

The indicator or display 202 connected to the central processing unit (CPU) digitally displays, all or part of the necessary data fed in from the input unit, a check digit, etc.

The central processing unit (CPU) is composed of a memory to store the necessary data fed in by means of the above-mentioned input unit 201. The memory also stores the output data corresponding to this necessary data. The CPU also includes an arithmetic unit to compute the date of expiration of the effectiveness of the merchandise, the check digit, etc., and a control unit to control the data transfer and the operations of the indicator 202, label feeding mechanism 203 and printing mechanism 204.

In the rear portion inside the aforementioned cabinet 200*a* is a roll of a base sheet with labels (A), which is rotatably supported on a shaft. Near the reel is a guide roller 207, and in the upper front of the guide roller are a feed roller 208 and pressure roller 208' positioned to be opposite from each other so that the base sheet with labels (A) may be bed between the rollers 208 and 208' via the guide roller 207.

Feed roller 208 is driven by a stepping motor or other feed motor 209 to be intermittently rotated for transporting the base sheet with labels (A).

The base sheet with labels (A) is separably provided with labels (C, C, . . . ) at predetermined intervals.

On the path through which the above-mentioned base sheet (A) is transported, there is a label position detector 211 to cause the above-mentioned motor 209 to stop when it detects the position of a predetermined succeeding label.

The label feeding mechanism 203 is composed of the above-mentioned feed motor 209, feed roller 208, pressure roller 208' and label position detector 211.

On the base sheet (A) transporting path before the above-mentioned feed roller 208, a printing head 212 and platen roller 213 are provided opposite one another so that the base sheet (A) may pass between them. Printing head 212 and platen roller 213 comprise the printing mechanism 204.

The printing head 212 prints the necessary data on the label (C) passing under the printing head 212 when it receives a signal from the electronic control of the central processing unit (CPU) printing mechanism 204 comprises, for example, a thermal-head, a wire-dot, an ink-jet, a discharge-destruction, an electrostatic recording, a photosensitive-recording or other dot-system printer, or type wheel system printer. Illustrated in FIGS. 36–40 is an example of the heat-sensitive printing system (either a color-developing or a copy-printing type) using a thermal head.

It is within the scope of the present invention to reverse the positions of the above-mentioned label feeding mechanism 203 and printing mechanism 204 with respect to the direction in which the labels are conveyed.

In front of the aforementioned feed roller 208, and pressure roller 208', there is a cutter 214 to cut the label base sheet (A). Cutter 214 is under the control of the central processing unit (CPU) add cuts the base sheet with labels (A) when the number of labels (C) reaches a predetermined number.

Further, the aforementioned feed motor 209 is provided with a pulley 215 which integrally rotates with the motor. The rotation of this pulley 215 is transmitted to feed roller 208 through a belt 216 for feeding the base sheet with labels (A) intermittently and is also transmitted to take-up shaft 218 through another belt 217. A fixing pin 219 is provided at a position a small distant from the take-up shaft 218. Also provided is a solenoid 220 to be operated with the signal from the CPU for starting the issue of a needed number of labels (C) after feeding a length of base sheet with labels (A) sufficient to be as necessary for taken-up by shaft 218. Solenoid 220 resets counter 6, which is mounted within the cassette and is operated by the central processing unit to make the counter return to zero at the time of printing and loading with a predetermined number of labels is provided between the cutter 214 and take-up shaft 218.

After the side panel (not illustrated) of the label printer 200 is opened, the aforementioned cassette 1 is attached to the take-up shaft 218 and fixing pin 219. The take-up shat 218 is fitted in engaging hole 11 of the supporting shaft 10 of the cassette 1.

When data, such as the code number, price, date and a required number of labels to be issued is inputed into input unit 201, this data is sent, to the central processing unit (CPU), the printer 200 is subsequently started, the input data is displayed on the display unit 202, and the check digit is automatically computed based on a input data and is displayed at the predetermined position in the display section 202. Next the start switch of the function keys 206 is turned-on, and the feed motor 209 begins the label feed. Simultaneously, the necessary data that has been fed in to the printer are transferred from the central processing unit (CPU) to the printing section, and the printing head 212 automatically prints the code number, price, bar code, etc. on the label C in accordance with the input data. The necessary data is printed on the labels (C, C, . . . ) on the base sheet in sequence by the above series of operations, and the base sheet with labels (A) is sent into the opening of the cassette 1 by means of the feed roller 208. The base sheet with labels (A) is then securely wound on the supporting shaft 10 by first feeding a base sheet with labels (A) of sufficient length so that it can be taken-up by shaft 218, either, while labels (C) are being printed or while the or are not printed, and stopping the feed ((except when an automatic loading mechanism, which is not shown in the drawings,) is provided) and the tip of the base sheet with labels (A is inserting into slit 12 of supporting shaft 10 to be held there. Thereafter, the solenoid 220 is actuated to permit a reversible counter 6 display "O", the conveyance of the base sheet with labels (A) is restarted, and the base sheet with labels (A) is taken up into the cassette 1 while the needed number of labels (C) are being issued. In addition an excess length of the base sheet with labels (A) which is at least as long as the distance from a separating plate 4 to a feed roller 7 (the length needed for the portion shown with the broken line having two data in FIG. 38, and other portions) is also bed into the cassette 1. Next, the base sheet with labels (A) is cut by cutter 214 whose operation is interlocked with a signal that terminates the take-up of the base sheet. At that time, the reversible counter 6 counts the needed number of labels (C) and the labels (C) which are sent as the excess. Therefore, at the time the base sheet with labels (A) are fed out of cassette 1 (which is removed from printer 2*a*) as shown with a two-dot broken line D in FIG. 38, the net number of printed labels (C) is secured by drawing the base sheet with lables (A) out of cassette 1 until reversible counter 6 counts to the needed number of labels.

If the printing mechanism 204 is a dot-system printer, a continuous pattern of straight lines is disposed over the entire printing elements (e.g. a check pattern) which may be printed on a desired number of labels (C) within the above-mentioned excess length of the base sheet with lables (A) after printing the needed number of labels (C) in order to check the performance of the printing head of the printing mechanism 204 by detecting possible discontinuous portions in the printed check patterns.

Figure 39:
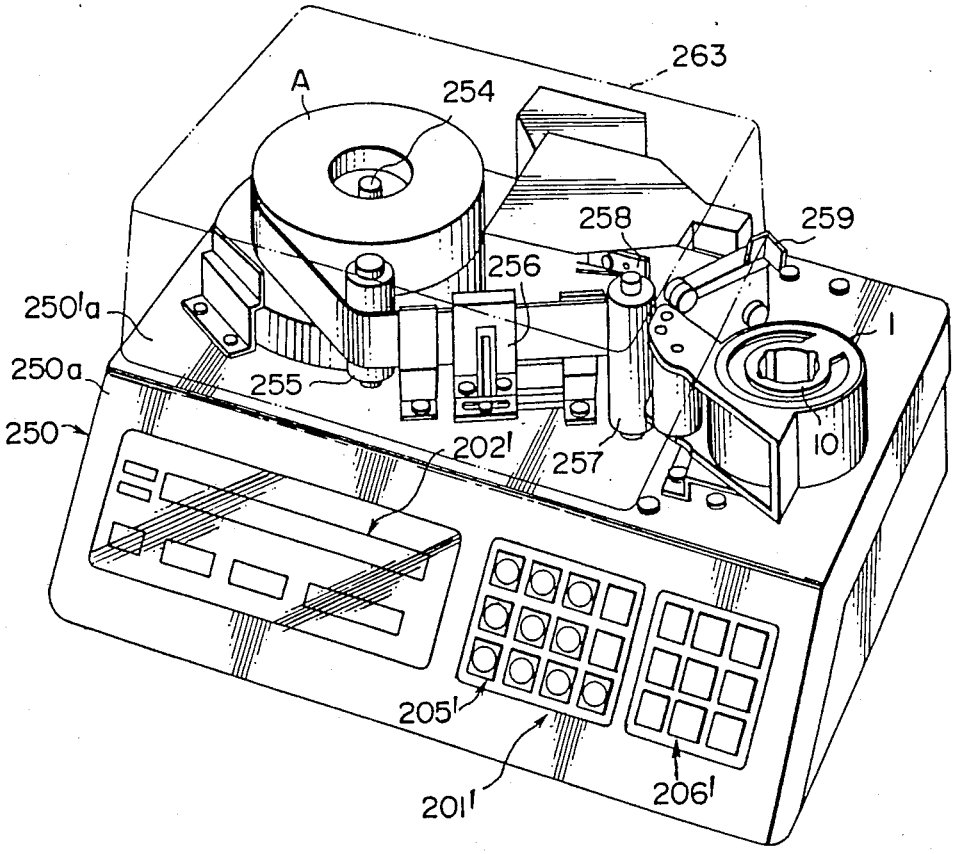
FIG. 39 is a perspective view of another embodiment of the label printer.
Figure 40:
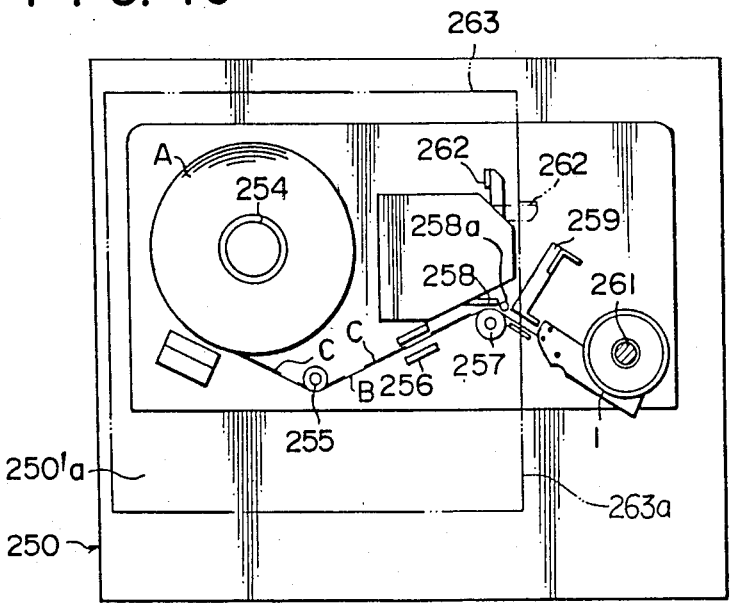
FIG. 40 is a plan view of the printer shown in FIG. 39.

The process of beading the base sheet with printed labels into the cassette may be carried out by a label printer 250 as illustrated in FIGS. 39 and 40. The cassette shown in FIGS. 39 and 40 is similar to the aforementioned cassette 1.

The label printer 250 comprises a supply reel 254, guide roller 255, detector 256, platen roller 257, thermal head 258, auxiliary roller 258*a*, cutter 259 and take-up shaft 261 atop a cabinet 250*a* with the bottom end of each of the above members supported on the top face of the cabinet. The above-mentioned members 254, 255, 257, 258*a* and 261 are rotatably mounted and perpendicular to a horizontal base plate 250'*a* at the top of the cabinet 250*a*.

A roll of base sheet with labels (A) is horizontally rotatably set on the above-mentioned supply reel 254, and the supporting shaft 10 of the cassette 1 is rotatably mounted on the take-up shaft 261.

There is a clearance in the detector 256, and there is also clearance between the platen roller 257 and thermal head 258, between the platen roller 257 and auxiliary roller 258*a* and in the cutter 259, respectively, in order to permit the base sheet with labels (A) pass therethrough. In addition these clearances are open at the top in order to let the base sheet with labels (A) to be inserted there in the lateral direction of the base sheet.

The thermal head 258 and auxiliary roller 258*a* are adapted to contact and be separated from platen roller 257 by the operations of the lever 262.

The reference number "263" denotes a transparent hollow cover which covers the aforementioned members 254, 255, 256 and 257 and thermal head 258 and is provided with an opening adapted to permit the base sheet (A) to be moved out of cover 263 on the right side 263*a* therefore, as seen in FIG. 40. The base sheet (A) supplied from the supply reel 254 is fed passed the guide roller 255 and label feed detector 256 and then is fed between the platen roller 257 and the thermal head 258 and auxiliary roller 258*a*, and, after necessary data are printed on the label by means of the thermal head 258, the base sheet (A) passes to the cutter 259 and is taken up on the supporting shaft 10 of the cassette 1 to be stored therein.

In FIG. 39, an input unit 201', a display or indicator 202', ten-keys 205' and function keys 206' are also shown.

I claim:

1. A label printer and cassette assembly for printing labels attached to a base sheet roll which is to be stored in a cassette case, said assembly including a printer and a cassette case which is adapted to be positioned on said printer to receive a plurality of said labels positioned on said roll, said printer and cassette assembly comprising:

(a) a printer including:
- (i) an input unit comprising means for inputting data for printing on said labels;
- (ii) a central processing unit for receiving said data from said input unit;
- (iii) a printing mechanism for printing on said labels, said printing mechanism being controlled by said central processing unit;
- (iv) means for detachably receiving said cassette case on said printer;
- (v) a base sheet feeding mechanism comprising means for feeding said base sheet through said printer and into said cassette case when said cassette case is positioned on said printer;
- (vi) a take-up shaft to which said cassette case is adapted to be attached when said cassette case is positioned on said printer, and around which said base sheet is adapted to be wound;
- (vii) a cabinet having a top face wherein said feeding mechanism and shaft are rotatably mounted on said top face of said cabinet; and
- (vii) a supply reel mounted on the top face of said cabinet which is adapted to receive said base sheet; and (b) a cassette case which is adapted to be positioned on said printer to receive said printed roll of labels, said cassette case comprising:
- (i) a hollow housing for storing a rolled base sheet having labels thereon;
- (ii) a central hub in said hollow housing into which said take-up shaft is adapted to be rotatably positioned, said central hub comprising means for rotatably engaging said shaft when said cassette is mounted on said printer, said shaft thereby comprising means for rotatably driving said central hub of said housing when said cassette is positioned on said printer;
- (iii) said housing comprising a single common outlet opening and inlet opening, the remainder of said housing being closed around said hub and said rolled base sheet with labels thereon; and
- (iv) a dispenser positioned near said common inlet and outlet opening, wherein said cassette is adapted to be removably attached to said printer so that said opening forms part of a printed label transportation path; and (v) a transparent hollow cover for covering said supply reel, said feeding mechanism and said printing mechanism, said cover having an opening therein adjacent said printing mechanism to print said labelled base sheet to be fed therethrough to said cassette case and to a cutter which is mounted on said printer, said take-up shaft and said cassette mounted to said shaft being positioned on said cabinet top face and outside of said transparent cover.

2. The printer defined by claim 1 further comprising means for winding said base sheet in a roll in said cassette case.

3. The printer defined by claim 2 further comprising means for synchronizing said winding of said base sheet by said winding means with said feeding of said base sheet by said feeding mechanism.

4. The printer defined by claim 3 wherein said printer cabinet houses said input unit and said central processing unit, and wherein said printing mechanism is mounted on said cabinet.

5. The printer defined by claim 4 wherein said feeding mechanism comprises means for feeding a length of said base sheet sufficient to be wound in said cassette case before said labels are printed on by said printer.

6. The printer defined by claim 4 wherein said cutter comprises means for cutting said base sheet after a predetermined number of labels are fed into said cassette case.

7. The printer defined by claim 4 wherein said feeding mechanism comprises:

(i) a feed motor;

(ii) a feed roller;

(iii) a pressure roller, wherein said base sheet is disposed between said feed roller and said pressure roller, and wherein said feed motor rotates said feed roller; and (iv) a label position detector for detecting the position of said label and for selectively stopping said feed motor.

8. The printer defined by claim 7 wherein said printing mechanism comprises a printing head and a platen roller, wherein said base sheet is fed between said platen roller and said printing head.

9. The printer defined by claim 7 wherein said printing mechanism is upstream of said feeding mechanism.

10. The printer defined by claim 7 further comprising:

a pulley attached to said feed motor, wherein said feed motor is adapted to rotate said pulley and said pulley is rotatably connected to said feed roller; and a belt for attaching said shaft to said pulley, whereby rotation of said feed roller is synchronized with rotation of said shaft.

11. The printer defined by claim 10 wherein said shaft is adapted to receive said base sheet to be wound therearound so as to form a roll on said shaft.

12. The printer defined by claim 1 wherein said base sheet is in the form of a roll and wherein said printer further comprises a shaft adapted to receive a roll of said base sheet after a predetermined number of labels are printed.

13. The printer defined by claim 1 wherein said shaft, said feeding mechanism and said printing mechanism are rotatably mounted about respective axes which are perpendicular to said top face of said cabinet.

14. The printer defined by claim 13 wherein said labeled base sheet is in the form of a roll and wherein said printer further comprises a supply reel rotatably mounted on said top face of said cabinet, adapted to receive said roll.

15. The printer defined by claim 14 further comprising:

said cutter having two spaced apart members;

a detector having two spaced apart members; and wherein said printing mechanism further comprises:

(i) a platen roller;

(ii) a thermal head; and (iii) an auxiliary roller, wherein said platen roller is spaced apart from said thermal head and said auxiliary roller, and wherein said labeled base sheet is fed by said feeding mechanism between said two spaced apart members of said cutter and said detector, between said platen roller and said thermal head, and between said platen roller and said auxiliary roller.

16. The printer defined by claim 14 wherein said printing mechanism comprises:

(i) a thermal head;

(ii) a platen roller;

(iii) an auxiliary roller; and (iv) a lever, wherein said thermal head and said auxiliary roller are adapted to move between positions in which said thermal head and said auxiliary roller contact said platen roller and in which said thermal head and said auxiliary roller are spaced from said platen roller in response to the operation of said lever.

17. A label printer and cassette assembly for printing labels attached to a base sheet roll which is to be stored in a cassette case, said assembly including a printer and a cassette case which is adapted to be positioned on said printer to receive a plurality of said labels positioned on said roll, said printer and cassette assembly comprising:

(a) a printer including:

(i) an input unit comprising means for inputting data for printing on said labels;

(ii) a central processing unit for receiving said data from said input unit;

(iii) a printing mechanism for printing on said labels, said printing mechanism being controlled by said central processing unit;

(iv) means for detachably receiving said cassette case on said printer;

(v) a base sheet feeding mechanism comprising means for feeding said base sheet through said printer and into said cassette case when said cassette case is positioned on said printer;

(vi) a take-up shaft to which said cassette case is adapted to be attached when said cassette case is positioned on said printer, and around which said base sheet is adapted to be wound; and (vii) a cabinet having a top face wherein said feeding mechanism and said shaft are rotatably mounted on said top face of said cabinet; and (b) a cassette case which is adapted to be positioned on said printer to receive said printed roll of labels, said cassette case comprising:

(i) a hollow housing for storing a rolled base sheet having labels thereon;

(ii) a central hub in said hollow housing into which said take-up shaft is adapted to be rotatably positioned, said central hub comprising means for rotatably engaging said shaft when said cassette is mounted on said printer, said shaft thereby comprising means for rotatably driving said central hub of said housing when said cassette is positioned on said printer;

(iii) said housing comprising a single common outlet opening and inlet opening, the remainder of said housing being closed around said hub and said rolled base sheet with labels thereon;

(iv) a label counter which comprises means for counting the number of labels taken up by said cassette from said printer; and (v) a dispenser positioned near said common inlet and outlet opening, wherein said cassette is adapted to be removably attached to said printer so that said opening forms part of a printed label transportation path.

18. A printer and cassette assembly defined by claim 17 wherein said printer further comprises a platen roller and an auxiliary roller, said auxiliary roller being arranged downstream of said platen roller, said auxiliary roller and said platen roller being positioned along said label transportation path, said path being traversed by the said base sheet and the labels attached thereto, said path extending from a supply reel on which said base sheet and said attached labels are positioned, prior to printing, to said cassette.

19. A label printer and cassette assembly for printing labels attached to a base sheet roll which is to be stored in a cassette case, said assembly including a printer and a cassette case which is adapted to be positioned on said printer to receive a plurality of said labels positioned on said roll, said printer and cassette assembly comprising:

(a) a printer including:

(i) an input unit comprising means for inputting data for printing on said labels;

(ii) a central processing unit for receiving said data from said input unit;

(iii) a printing mechanism for printing on said labels, said printing mechanism being controlled by said central processing unit;

(iv) means for detachably receiving said case on said printer;

(v) a base sheet feeding mechanism comprising means for feeding said base sheet through said printer and into said cassette case when said cassette case is positioned on said printer;

(vi) a take-up shaft to which said cassette case is adapted to be attached when said cassette case is positioned on said printer, and around which said base sheet is adapted to be wound; and (vii) a cabinet having a top face wherein said feeding mechanism and said shaft are rotatably mounted on the top face of said cabinet; and (b) a cassette case which is adapted to be positioned on said printer to receive said printed roll of labels, said cassette case comprising:

(i) a hollow housing for storing a rolled base sheet having labels thereon;

(ii) a central hub in said hollow housing into which said take-up shaft is positioned to be rotatably positioned, said central hub comprising means for rotatably engaging said shaft when said cassette is mounted on said printer, said shaft thus comprising means for rotatably driving said central hub of said housing when said cassette is positioned on said printer;

(iii) said housing comprising a single common outlet and inlet opening, the remainder of said housing being closed around said hub and said rolled base sheet with labels thereon; and (iv) a dispenser positioned near said common inlet and outlet opening, wherein said cassette is adapted to be removably attached to said printer so that said opening forms part of a printed label transportation path, wherein said printed label transportation path further comprises a reversible counter, said reversible counter comprising means for counting and indicating the amount of labels in the cassette when said printed labels are taken up by said cassette, said reversible counter including means for resetting said counter, said printer comprising means for activating said counter resetting means in response to said central processing unit.

20. A label printer and cassette assembly in accordance with claim 19 wherein said reversible counter is positioned within said hollow housing, indicating the number of labels in said cassette when said cassette is attached to a hand labeller and when labels are dispensed from said hand labeller.

21. A method of printing labels attached to a base sheet roll with a printer and storing said roll within a cassette case which is adapted to be positioned within a hand labeller, said method comprising:

(a) positioning said labelled roll on the top face of a printer;

(b) inputting data into a central processing unit of said printer;

(c) detachably positioning said cassette case around a take-up shaft on a top surface of said printer;

(d) printing on said labels with said printing mechanism in response to instructions sent by said central processing unit to said printing mechanism;

(e) feeding said base sheet through said printing mechanism for printing said labels and into a substantially closed hollow housing in said cassette case via a single common outlet and inlet opening on said case;

(f) winding said printed labels about a central hub of said cassette case when said case is positioned about said shaft, said central hub being rotatably driven by said shaft;

(g) counting and indicating the number of labels in the cassette case with a reversible counter which is positioned within said cassette case when said printed labels are fed into said cassette case;

(h) inserting said cassette case, with said printed labels, into a hand labeller; and (i) dispensing said labels from said hand labeller, counting the number of labels remaining in the cassette case, and indicating said number of labels remaining on said reversable counter.

* * * * *

UNITED STATES PATENT AND TRADEMARK OFFICE

CERTIFICATE OF CORRECTION

PATENT NO. : 4,669,381

DATED : June 2, 1987

INVENTOR(S) : Toshio NAKAJIMA

It is certified that error appears in the above-identified patent and that said Letters Patent is hereby corrected as shown below:

At column 2, line 28, "printed" is deleted;

At column 3, line 47, "a" is deleted before "still";

At column 5, line 50, "sticked" should read ---stuck---;

At column 6, line 13, "is projected" should read ---projects---;

At column 6, line 51, "consists of" should read ---comprises---;

At column 8, line 2, "a" is deleted before "around";

At column 9, line 58, "set for immediate issue" should read ---set to immediately issue---;

At column 10, line 34, "164" should read ---154---;

At column 12, line 47, "is" is deleted;

At column 13, line 52, "bed" should read ---fed---;

At column 14, line 8, "(CPU) printing mechanism" should read ---(CPU). Printing mechanism---

At column 14, line 23, "add" should read ---and---;

At column 14, line 37, "as necessary for" is deleted;

At column 14, line 46, "Shatt" should read ---shaft---;

At column 14, line 49, "inputed" should read ---inputted---;

UNITED STATES PATENT AND TRADEMARK OFFICE

CERTIFICATE OF CORRECTION

PATENT NO. : 4,669,381

DATED : June 2, 1987

INVENTOR(S) : Toshio NAKAJIMA

It is certified that error appears in the above-identified patent and that said Letters Patent is hereby corrected as shown below:

At column 14, line 50, "," is deleted after "sent";

At column 15, line 3, "while the or are" should read ---while they are---;

At column 15, line 3, ---being--- is inserted before "printed";

At column 15, line 6, "labels (A" should read ---labels (A) ---;

At column 15, line 17, "bed" should read ---fed---;

At column 15, line 27, "lables" should read ---labels---;

At column 15, line 34, "lables" should read ---labels---; and

At column 15, line 39, "beading" should read ---feeding---.

Signed and Sealed this

Fifteenth Day of March, 1988

*Attest:*

*Attesting Officer*

DONALD J. QUIGG

*Commissioner of Patents and Trademarks*